United States Patent [19]

Weigl et al.

[11] 3,997,343

[45] Dec. 14, 1976

[54] MATERIAL FOR ELECTROSTATIC RECORDING

[75] Inventors: John W. Weigl, West Webster; Alan Amidon; Joseph Mammino, both of Penfield, all of N.Y.

[73] Assignee: GAF Corporation, New York, N.Y.

[22] Filed: Oct. 18, 1972

[21] Appl. No.: 298,587

Related U.S. Application Data

[63] Continuation of Ser. No. 110,350, Jan. 27, 1971, abandoned, which is a continuation of Ser. No. 723,323, April 18, 1968, abandoned, which is a continuation of Ser. No. 462,931, June 10, 1965, abandoned.

[52] U.S. Cl. ..... 96/1.8; 96/1.5; 96/1 TE; 427/14; 428/414; 428/483; 428/520; 428/539

[51] Int. Cl.[2] ..... G03G 5/08; G03G 5/06

[58] Field of Search ..... 96/1 R, 1.1, 1.5, 1.8

[56] References Cited

UNITED STATES PATENTS

| | | | |
|---|---|---|---|
| 2,901,348 | 8/1959 | Dessamer et al. | 96/1.5 |
| 3,547,628 | 12/1970 | Wolff | 96/1.1 |

*Primary Examiner*—Roland Martin, Jr.

*Attorney, Agent, or Firm*—Walter C. Kehm; James N. Blauvelt

[57] ABSTRACT

An electrostatic recording element suitable for use as a receiving sheet in an electrostatic transfer process, consisting essentially of: a translucent, non-conductive base selected from the group consisting of paper, a polyester film, and a polyvinyl fluoride film; a photoconductive layer on the surface of said base comprising a photoconductive zinc oxide and a dye sensitizer suspended in an insulating resin binder selected from the group consisting of a vinyl acetate - crotonic acid copolymer and epoxy esters; and a dielectric polymer resin film overlying said photoconductive layer selected from the group consisting of polyvinyl acetate, vinyl acetate - crotonic acid copolymer, and acrylonitrile - styrene copolymer.

1 Claim, 8 Drawing Figures

MATERIAL FOR ELECTROSTATIC RECORDING

This is a continuation of application Ser. No. 110,350, filed Jan. 27, 1971, now abandoned, which is a continuation of prior application Ser. No. 723,323, filed Apr. 18, 1968, now abandoned, which in turn was a continuation of prior application Ser. No. 462,931, filed June 10, 1965, now abandoned.

This invention relates to material and equipment for electrostatic recording and particularly concerns a novel type of recording element which is especially suited for photographic and non-photographic electrostatic printing, charge transfer xerography and for the recording of electrostatic signals in general.

It is well known in the prior art that electrostatic charge patterns may be deposited upon thin dielectric layers provided that such layers are backed by conductive elements. For example, in the past charge patterns have been applied from selectively formed and/or activated high voltage wires through pattern stencils by contact with corresponding matrices of charged metal and the like. The transfer of xerographic patterns from a photographic plate or drum to a receiving sheet also is well known in the art.

Electrostatic latent images, formed by any of the means mentioned above, are normally rendered visible by means of fine electroscopic powders or other finely divided and charged particles sometimes called "toners". These are suspended in air or in insulated liquids, or otherwise brought into contact. Such toner powders may also be attached to carrier particles such as beads or brushes, etc. The toner image may be permanently fixed to the recording medium, e.g. by thermal fusion with a fusible resin binder, or by solvent evaporation of a resinous solution or suspension to leave a resinous bonding layer.

In all these processes there is a requirement for a thin dielectric member, for example of the order of 1/10 to 1.0 thousandth of an inch thick, which serves to retain the charge. There is also a requirement for a conductive backing member which, when grounded, serves to conduct charge of opposite polarity to the back side of the dielectric during the deposition of the charged pattern upon its front face. That is to say, the conductive member acts as a condenser plate and serves to convert a pattern of net charge to one of dipole charge.

In all the various types of recording elements used for these processes, permanently semi-conductive or conductive backings have been felt in the past to be essential in the recording sheet. These were considered necessary to enable the dielectric to accept and retain the charge patterns. In the absence of a conductive second member, it was thought, no effective electrostatic pattern or image could be formed.

Thus, the prior art has suggested that relatively highly conductive materials, such as carbon-filled paper and metal foil be used for these purposes. These have been used commercially in the past, to some degree, together with insulating resin overcoatings to form the dielectric layer. However, these recording materials have not been entirely satisfactory. For one thing, they lack translucency because of the necessity for either a metal layer or a pigmented conductive backing. This has limited their utility in photography. Images formed on them can not be recopied on conventional diazo type apparatus. Moreover, these materials lack the aesthetic appeal and simplicity of handling of white paper. Also, they are relatively expensive.

Therefore, while it is possible, in principle, to use papers or other supports which have been rendered conductive by means, for example, of a partially transparent layer of vacuum evaporated metal, such as aluminum, chromium, or the like, this procedure is prohibitively expensive for most purposes. These suggested procedures have not met with commercial success for recording of electrostatic patterns or data.

Attempts have also been made in the past to circumvent the above drawbacks by the use of resin-coated white backing papers without special conductive coatings, which have some inherent conductivity. These have not been successful because ordinary paper becomes excessively nonconductive or insulating at ambient dry atmospheric conditions, i.e., below about 25–30% relative humidity. Hence, paper which is somewhat conductive under humid conditions cannot be relied upon to act as the conductive backing medium under the 10 to 20% relative humidity conditions which are frequently met with in offices lacking special air-conditioning or heated without humidification.

Humectants and anti-static agents have been incorporated in base papers in an attempt to provide adequate conductivity at low humidity but these have not been entirely satisfactory. As a matter of fact, the humectants fail below about 25% relative humidity and the anti-static agents fail, even on film base, below about 20% relative humidity. Other treatments are not capable of making common types of white or translucent papers adequately conductive.

In principle, the internal humidification of electrostatic facsimile apparatus might be expected to overcome the drawbacks. In practice, however, it leads to various difficulties including spillage, arc-over and internal corrosion. The presently known transparent and translucent film bases are high insulators. They are not adequately conductive and the lack of an economical clear, semi-conductive layer or a truly effective anti-static coating has precluded the use of many of these materials as backings for dielectric members such as are used in electrostatic recording.

Therefore, it appears to be eminently desirable to provide improved electrostatic recording papers and films. These should neither require conventional opaque coatings nor metal treatments, and the application of expensive and uncertain anti-static treatments to the base sheet should be avoided.

The present invention is based on the surprising discovery that the conventional and normally non-conductive layers of photoconductive material, when actinically illuminated or pre-illuminated, may be substituted for the more permanently conductive precoats which have been deemed essential in the prior art. It is therefore, a prime object of this invention to provide attractive, economical and effective electrostatic recording sheets without resorting to the special coatings and treatments deemed necessary in the past.

It is a further object to provide a process whereby sheets of this character may be employed to form images under a wide range of ambient conditions of temperature and humidity.

A further object is to design simple materials and equipment, including a system or an apparatus for employing the improved recording materials of this invention.

A still further object of this invention is to provide simple means whereby many types of existing electrostatic recording apparatus may be converted for use with the materials and equipment of this invention.

Further objects will become more clear from the detailed description of this invention which follows.

In general terms, the invention contemplates the illumination, under suitable conditions, of photoconductive layers which have been applied as pre-coats or incorporated otherwise in the sheet material which is to form the record. Means for incorporating photoconductors in paper have been described in various publications in the past. Methods of dissolving photoconductors in film base "dopes" also are known. One may also apply a photoconductive back layer to an insulating polymeric film which itself acts as the recording dielectric. Alternatively, the paper side of a resin coated or laminated paper may be coated or impregnated with a photoconductor, in which case the resinous layer becomes the dielectric. In the last two cases mentioned, it is usually preferable to pre-illuminate the photoconductive layer from the unobstructed side of the paper sheet rather than try to illuminate through the sheet.

Light colored and translucent photoconductors per se are well known, though they have not been used hitherto for electrostatic facsimile recording. Neither have these been illuminated uniformly in advance of recording to form discrete temporarily semi-conductive layers as far as applicants are aware. Instead, they have been used for photoelectric detectors, for use in television cameras and the like.

In electrostatic recording processes, it is necessary to have base conductivity only during the recording and optionally during the development step. Ordinarily it does not matter much whether the base is conductive prior to the charging of the pattern or after the processing. Hence, according to the present invention, it is entirely sufficient to produce or induce a temporary semi-conductive state in a photoconductive backing layer. This may be done essentially during image recording by means of prior or simultaneous actinic illumination.

The conventional conductive layers used in the prior art as mentioned bove must necessarily include dark or metallic conductive pigments. By contrast, photoconductive layers, according to the present invention, may be either white, or colored, opaque, translucent or transparent depending on what is most convenient, most economical and most attractive aesthetically. In addition, many of the effective photoconductors are inherently quite inexpensive and they may be applied by well known methods. All photoconductors which are capable of giving conductivities in excess of $10^{-8}$ mho-sq. cm. under conditions of practical illumination are suitable for purposes of the present invention. Since most photoconductors retain much of their photo-induced conductivity for an appreciable time period after actinic illumination, it is not necessary to illuminate them or most of them during the actual recording. For purposes of the present invention, it is generally sufficient to pre-illuminate the photoconductors a few seconds prior to charging. Thus, they may be run through a processing sequence where the charge is applied at one station or position in or adjacent to recording equipment and the exposure for photographing takes place at a later station. Typical photoconductors usually should be pre-illuminated during the time interval of from 1–15 seconds prior to charging.

The requirement for minimum conductivity of the order of $10^{-8}$ mho-sq. arises out of the need for rapid movement from the ground of image charged from one point to another. Sufficient time must be given for the image charge to migrate and keep up with the rate of surface charge deposition. For practical facsimile recorders, the time required for shifting of the charge is between about 0.1 and 10 micro-seconds per resolvable area, i.e., per square mil of area.

As is well known, the time constant for charge migration through a semi-conductive layer is determined by the product of volume resistivity and capacitance per unit area, i.e.

$$\tau = \rho = 8.85 \times 10^{-14} \epsilon P$$

where $\tau$ = time constant (in seconds), $\rho$ the volume resistivity (ohm cm.), $\epsilon$ the static dielectric constant and $8.85 \times 10^{-14}$ a dimensional conversion constant (coulombs/volt cm), called the "permittivity of free space."

Photoconductors of the type suitable for this invention may be applied to or incorporated in any desired support or substrate. Such supports may include parchment or paper, coated or uncoated, filled and otherwise, and resinous film bases of all kinds.

Table I, which follows, lists a large number of suitable photoconductors which may be used and any of these may be selected, depending upon the particular characteristics desired. The table also indicates practical methods of application, color, opacity, and wavelength range of their greatest actinic sensitivity. Typical reference sources are also listed.

TABLE I

| Representative Photoconductors | Physical Form | Typical Binder Resin | Color | Wavelength Range of Max. Sensitivity | Reference |
|---|---|---|---|---|---|
| Polycyclic hydrocarbons | Clear resins | — | Colorless Yellow | <4200 A.U. | Sokolowski & Szymanowski Ball.Acad.Sci.Pol.8,191('60) |
| Azomethines | Solid solutions | Polyamide | Colorless | 3600–4000 A.U. | Germ. 1,060,712 (Kalle) |
| Terphenyl derivatives | Solid solutions | Polycarbonate | Colorless | <4200 A.U. | Germ. 1,060,259 (Agfa) |
| Fluorol dyes (2 aryl, 4 arylidine oxazolones) | Solid solutions | Polystyrene | Colorless-Yel.-Green | Various | Fr. 1,176,381 (Kalle) |
| Anthraquinone, etc. | Solid solutions | Polycarbonate | Yellow | <4200 A.U. | Germ. 1,031,127 (Agfa) |
| Pyrazoline derivatives | Solid solutions | Coumarin-indene | Colorless-Yellow | 3600–4200 A.U. | Belg. 563,045 Fr. 1,191,326 Germ. 1,060,714 (Kalle) Br. 853,880 |
| Aminophenyl oxazoles | Soln's. or suspensions | Resin modified maleic | Colorless-Yellow | 3600–4200 A.U. | Belg. 581,861 (Kalle) |
| Substituted Poly(vinyl acetophenone), Poly(vinyl carbazole) & copolymers | Clear resins | — | Yellow-Red | 5000–6000 A.U. | Belg. 588,048 588,050 Gevaert 589,996 |
| Anthracene | Suspension | Paraffin | Colorless | <4000 A.U. | Kommandeur et al. Can. J. Chem, 36.513('58) |

TABLE I-continued

| Representative Photoconductors | Physical Form | Typical Binder Resin | Color | Wavelength Range of Max. Sensitivity | Reference |
|---|---|---|---|---|---|
| 4,5 diphenylimidazolones & imidazothiones | Solid solutions | Keto-resins | Colorless | 3600–4000 A.U. | Germ. 1,060,713 (Kalle) Can. 586,057 Belg. 562,426 |
| 2,5 bis(p-aminophenyl) 1,3,4 triazoles | Solid solutions | Keto-resins | Colorless | 3600–4000 A.U. | Germ. 1,060,260 (Kalle) |
| Cyclopentadiene-one derivatives | Suspensions | Pentaerythrytol-colophony esters | Colorless | <4000 A.U. | Belg. 585,450 (Gevaert) |
| Aryl Polyenes | Soln's. or suspensions | Polysulfonates | Colorless-Yellow | <4200 A.U. | Belg. 585,507 (Gevaert) |
| 1,3 diphenyltetrahydro-imidazole derivatives | Soln's. or suspensions | Keto-aldehyde | Yellowish | 3600–4200 A.U. | Belg. 581,404 (Kalle) |
| polymers of hydrocarbons linked by vinyl groups | Clear resins | — | Colorless-Yellow | <4500 A.U. | Belg. 592,558 (Kalle) |
| Polymers of heterocyclics linked by vinyl groups | Clear resins | — | Colorless-Yellow | <4500 A.U. | Belg. 592,557 (Kalle) |
| Zinc oxide | Suspension | Alkyd resins | White | 3200–3900 A.U. | Br. 835,044(Com.Australia) |
| ARomatic oxazoles, thiazoles, imidazoles | Solid solutions | ACrylic resins | Colorless-Yellow | 3600–4200 A.U. | Belg. 585,555 Belg. 589,239 Gevaert |
| Benzofuran derivatives | Solid solutions | Polyesters | Colorless-Yellow | 3600–4200 A.U. | Belg. 585,449 (Gevaert) |
| Substituted oxazoles, thiazoles, selenazoles | Suspensions | Polyvinyl butyral | Colorless-Yellow | <4500 A.U. | Belg. 587,301 (Gevaert) |
| Diarylmethane and phene-thiazine derivatives | Suspensions | Poly(vinyl carbazole) | Colorless-Yellow | <4500 A.U. | Belg. 587,794 (Gevaert) |
| Copolymers of substituted vinyl thiazoles & oxazoles | Clear resins | — | Colorless-Yellow | <4500 A.U. | Belg. 588,049 (Gevaert) |
| Aryl-subst. vinyl compounds | Soln's. or suspensions | — | Colorless-Yellow | 3600–4200 A.U. | Belg. 589,373 (Kalle) |
| 2,4,5 tri(aryl) or 2,4,5 tri(heterocyclo) imidazoles | Solid solutions | — | Colorless-Yellow | 3600–4200 A.U. | Belg. 589,417 (Kalle) |
| N-vinylheterocyclic polymers with additives | Clear resins | — | Colorless-Yellow | <4200 A.U. | Belg. 589,994 (Gevaert) |
| Aromatic-subst. triazoles | Soln's. or suspensions | Poly(vinyl carbazole) | Colorless-Yellow | <4200 A.U. | Belg. 589,995 (Gevaert) |
| Vinyl polymers & sensitizers | Clear resins | — | Colorless-Yellow | <4500 A.U. | Belg. 589,996 (Gevaert) |
| Substituted hydrazine derivatives | Soln's. or suspensions | Poly(vinyl carbazole) | Colorless-Yellow | <4500 A.U. | Belg. 590,299 (Gevaert) |
| N-substituted acrylic resins | Clear films | — | Colorless-Yellow | 3600–4200 A.U. | Belg. 591,347 (Kalle) |
| 2,5 bis(aminophenyl) 1,3,4 oxadiazoles | Solid solutions | Balsam | Colorless | 3600–4000 A.U. | Belg. 558,078 (Kalle) |
| Substituted hydrazines | Soln's, or suspensions | Poly(vinyl carbazole) | Colorless-Yellow | <4200 A.U. | Belg. 590,299 (Gevaert) |
| Imidazole 1,2,4 triazines | Suspensions | Poly(vinyl carbazole) | Colorless-Yellow | <4200 A.U. | Belg. 594,974 (Gevaert) |
| Alkyl, aryl triazines | Soln's, or suspensions | Keto resins | Yellow, orange,red | <4500 A.U. | Fr. 1,244,705 (Kalle) |

Dielectric overcoatings which may be applied over the photoconductor layer inclue a wide variety of insulating resins. These resins may be pigmented, if desired, with suitable insulating pigments such as finely divided mica, silica, or titania. These overcoatings may be applied as continuous films, by coating from solvent or aqueous solutions or by coating from latices or sols. They may be produced by casting or by extrusion of hot melts as well as by other means well known in the plastics art. Normal thicknesses which are required are in the range of 0.1 to 2.0 thousandths of an inch and preferably around 0.5 thousandths. These are similar to the thicknesses used in conventional conductorbacked electrostatic recording sheets.

The dielectric layers should have a high resistivity, preferably as high as $10^{12}$ ohms/cm.$^2$. The minimum resistivity should be in excess of $10^{10}$ ohms/cm.$^2$.

The process of the present invention will be further understood by referring to a detailed description which follows. Reference should also be made to the accompanying drawings wherein:

FIGS. 1–4 inclusive show in cross section, of exaggerated thickness, various forms of recording sheets made according to this invention, the recording side facing the top in each case.

Figure 1:
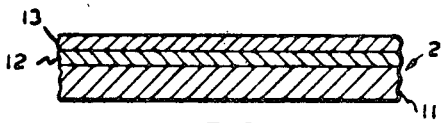

Referring now to FIG. 1, there is shown in enlarged or exaggerated cross-section thickness, a portion of a recording sheet suitable for electrostatic facsimile. This sheet, designated generally at 22, consists of a base 11 of suitable but not necessarily constant electrical properties, such as white paper, which may be highly insulative or somewhat conductive, depending to some extent, as a rule, on ambient atmospheric conditions. This is overcoated with a photoconductive insulating layer 12 which may consist, for example, of zinc oxide suspended in a resinous binder. On top is a dielectric coating 13 of suitable resin applied to cover the photoconductive layer.

Figure 2:
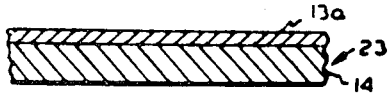

Referring to FIG. 2, a simpler sheet designated generally at 23 is shown consisting of a photoconductive insulating film base 14 overcoated with a clear or light colored dielectric coating 13.

Figure 3:
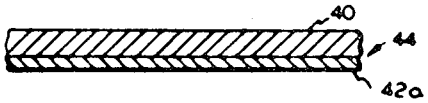

In FIG. 3, there is shown another sheet which is simple but may be inferior to the sheet of FIG. 1 in some respects. This composite sheet is indicated generally at 44 and consists of a very thin resinous film base 40 which acts both as a support and as a recording medium, being backed by a photoconductive insulator layer 12*a*. In this form of invention, the film base should be less than 2 thousandths of an inch thick and should have a dielectric constant in excess of 3.

Figure 4:
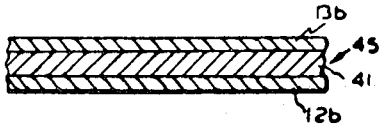

Referring to FIG. 4, there is shown a composite sheet, indicated generally at 45, which comprises a main support 41 coated on its upper or recording side by a dielectric layer 13*a* and on its back side by a photoconductive layer 12*b*.

Figure 5:
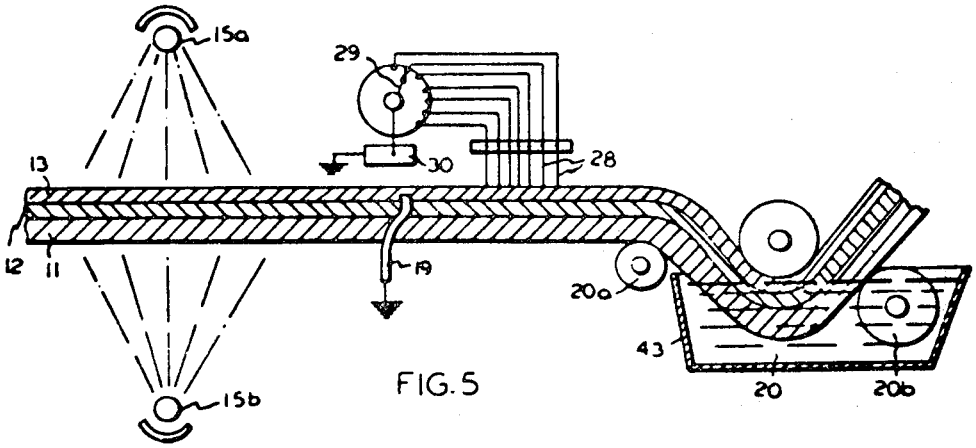
FIG. 5 shows diagrammatically a sequence of steps required for forming electrostatic images according to this invention. Sheet material is shown in exaggerated thickness.

In FIG. 5 there is shown a system for carrying out several steps on sheet material of the form shown in FIG. 1. The same reference characters are applied to the sheet. The base is indicated at 11, the photoconductive layer at 12 and the dielectric top coating at 13. The sheet is illuminated or pre-illuminated by passing it across sources of actinic radiation indicated at 15*a* and 15*b*, one above and one below the sheet. As the sheet progresses to the right, as seen in this figure, it becomes activated as indicated by the additional shading on the layer 12. This shading represents a considerable increase in the electrical conductivity of the photoconductive layer as induced by the irradiation. Illumination need not be both above or below. It can be in either position depending generally on which coating or layer 11 or 13 is the more translucent to the actinic radiation.

Further to the right, the pre-illuminated sheet, now partially conductive, may be subjected to a pattern-wise charging process. This is done by spreading or forming electrostatic charge patterns upon the dielectric layer 13 by means of an array of sharp individual needles indicated at 28. Each needle is connected to an appropriate source of power. Pre-illuminated temporary semi-conductive layer 12 is grounded by means of a metallic edge brush 19 which contacts this sheet. This establishes a reference potential.

Still further to the right, after the sheet has received its electrostatic charge or latent image, this charge or image may be rendered visible by passing the sheet into the tray 43 containing a liquid toner suspension indicated at 20. The liquid is non-conductive and the toner particles are charged. Guide rollers 20*a* and 20*b* lead the paper into and out of the tray.

Figure 6:
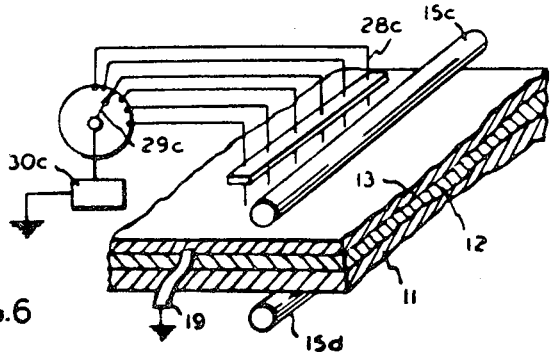
FIG. 6 shows diagrammatically the combining of the charging and exposure in a single operation.

Now referring to FIG. 6, an example is shown where the illumination or pre-illumination and the charging steps may be carried out substantially simultaneously. Here, the illumination means 15*c* and 15*d* correspond to the means in FIG. 5, except that they are located as near as possible to the same place where the actual pattern is being applied. Here the pattern is being applied by a set of needles 28*c* supplied with power from a power source 30*a*. The power to the needles, both individually and collectively, is under control of a suitable switch with proper actuating mechanism, indicated at 29*c*. In other respects, the system in this figure is essentially the same as the middle part of FIG. 5 and the same reference characters are applied.

Figure 7:
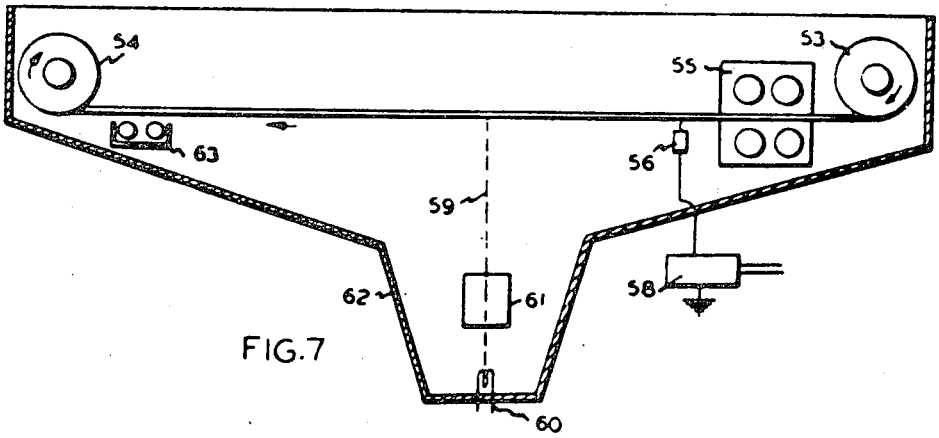
FIG. 7 shows in diagrammatic form an electrostatic recording equipment system or apparatus for practicing the invention.

Referring now to FIG. 7, there is shown another kind of a charging operation. In this case, an electrostatic pattern is applied to a recording sheet indicated at 52 and consisting of a thermoplastic dielectric layer supported on a clear photoconductive film base. A transport mechanism consists of a supply roller and a take-up roller, indicated at 53 and 54 respectively. This mechanism serves to carry the film past an illuminating station consisting of an array of suitably mounted ultraviolet fluorescent lamps indicated at 55. An edge brush 56 is provided to contact or slide against the edge of the pre-illuminated temporarily semi-conductive film base, impregnated with or containing as it does the photoconductive material. This brush applies a reference potential which may be ground, or may be some other potential if desired. The reference potential may be obtained from an adjustable power supply indicated at 58. An electrostatic charge pattern is then applied by means of an electron beam 59. This beam originates at a high voltage cathode indicated at 60 and passes between deflection electrodes 61. Both of these cathodes and electrodes may be controlled by electronic facsimile signals to be recorded. It is best to operate such electron beam recorders inside of an evacuated chamber and this is indicated at 62. In this manner a latent image or pattern is imposed on the sheet. Visible images, in this case, are best developed by thermal deformation of the dielectric surface. An infra-red radiation device, in the form of a heater element 63, is provided for this purpose.

Figure 8:
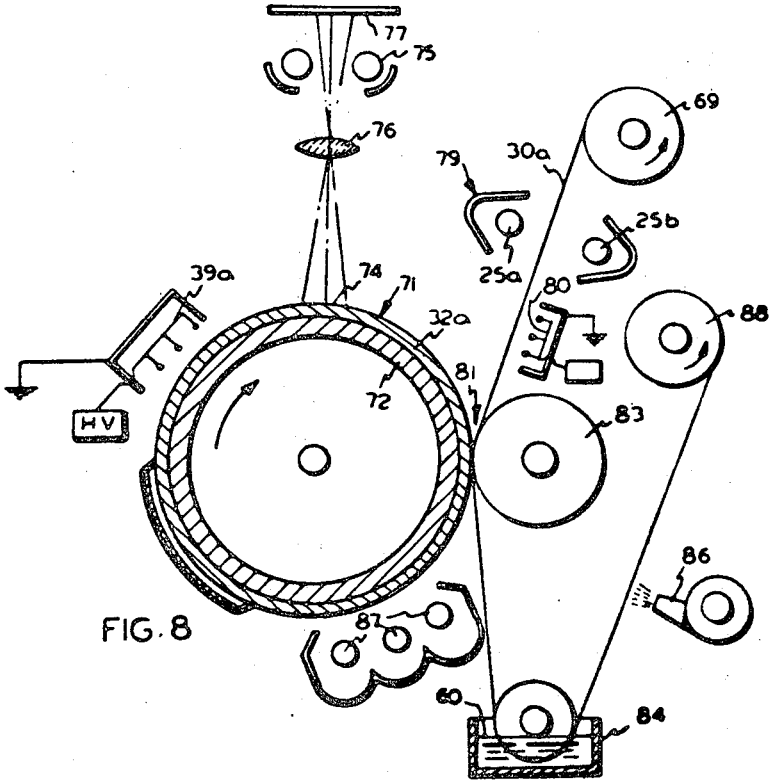
FIG. 8 is a schematic representation, in crossection, showing how the invention may be applied to a continuously operative xerographic printer using the transfer of image principle and employing sheet material similar to that of FIG. 1.

In FIG. 8 there is shown a schematic representation, in cross-section, of a continuously operated xerographic printer using the principle of transferring electrostatic images (TESI). Sheets prepared according to the preferred form of the invention, as illustrated in FIGS. 1 and 5, are used in the form of a continuous web. A set of corona wires or electrodes 39*a* deposit a substantially uniform charge upon a rotatable xerographic drum 71. This drum consists of a metallic cylinder 72 covered with a uniform film 32*a* of a photoconductive insulator. The photoconductor 32*a* next receives a pattern of actinic radiation at an exposure station 74. This station consists of conventional light sources 75 and a less 76 or other optical device suitable for projecting onto the drum the image of a portion of an original, e.g., a record 77. This record which may be a document, a page in a book, etc., is to be copied as a charge pattern onto the drum 71. A receiving sheet 30*a* is unrolled in continuous web form from the supply roller 69. It is uniformly pre-illuminated, and thereby rendered partially conductive, by a set of actinic lamps 25*a*, 25*b*, and is then pressed in intimate contact with the charged and pattern-wise exposed photoconductive layer 32*a* on the drum 71.

A corona pre-charging station 80 is provided of conventional design. It is situated between the pre-illumination device 79 and the transfer station at the bite of the rollers 71 and the cooperating platen roller 83. This sets up a different potential on the receiving sheet. A portion of the charge pattern on the drum is thereby transferred to the sheet material 30*a* as drum and sheet material come into contact at point 81. After separation of the receiving sheet 30*a* and the surface of the drum, the sheet or web continues on through an immersion device 84. This device contains a liquid suspension 60 of electroscopic toner particles in finely divided form. It could equally well be passed through a gaseous suspension of charged powder particles. These particles, or pigment material, are applied to the transfer sheet 30*a* in order to develop the latent electrostatic image upon it. The sheet is dried, if necessary, by a hot-air blower 86 and wound up on a receiving roller 88. After transfer of the image from the drum the latent imagebearing section of its photoconductive layer 32*a* is illuminated uniformly by actinic radiation from suitable light such as three tubular lamps 87. A reflective light shield reflects this radiation effectively and it is sufficiently intense to destroy essentially completely the residual charge pattern upon the drum 71. The drum is then kept dark for a portion of a turn to allow any residual general photoconductivity to decay. Hence, the drum may be used continuously. As the operation is repeated, a portion of the drum is again exposed at 39*a* to make it conductive and image receptive and the next print may then be reproduced.

It will be apparent to those skilled in the art that other modifications may be made in addition to those mentioned above. While zinc oxide is the preferred photoconductive material, most of those listed in Table I also can be used with appropriate exposures and handling.

A variety of charge transfer or "electrostatic printing" processes may be employed whereby a charge pattern is transferred to pre-illuminated photoconductive receiving member from a metallic printing plate, for example. This plate may be of the type which has raised print at a potential different from that of the ground. Or the transfer may be from a charged dielectric surrounded by grounded metallic areas. The receiving member need not be in the form of an extended sheet but may include solid photoconductors covered by thin dielectric layers. Alternatively, one may use dielectric solid bodies such as glass or plastic plates covered by thin layers in succession of photoconductor and dielectric material.

Sheet material like that illustrated in the first four figures, and particularly in FIG. 1, may be used to good advantage as a receiving sheet for a transferred xerographic toner image, either liquid or dry. This is particularly applicable when electric fields are used to transfer the toner material.

The invention will now be illustrated by specific examples.

EXAMPLE I

A poorly conductive bond paper of standard commercial quality was coated with a suspension of four parts by weight of unsensitized photoconductive zinc oxide (U.S.P. XII, New Jersey Zinc Co.) to one part of vehicle. The zinc oxide was suspended in a resin binder consisting of a copolymer of vinyl acetate and crotonic acid. A photoconductive film was formed of about 4 thousandths inch thickness when dry.

The coated sheet was overcoated with a layer of an insulating vinyl acetate copolymer emulsion about 0.35 mils thick when dry. This sheet was illuminated with a pair of 15 watt fluorescent lamps about 4 inches above the sheet so as to give an actinic illumination of about 70 milliwatts per square centimeter. A surface conductivity of the order of $2 \times 10^{-8}$ mho-sq. cm. was imparted. This was measured on part of the sheet which was not overcoated. During illumination, a sharply pointed recording probe having a tip diameter of approximately 3 mils, was connected to a voltage source at −600 volts. The probe was quickly passed over the resin coated surface in brushing contact with it so as to deposit an electrostatic pattern, as by light writing or drawing.

The edge of the photoconductive layer in this example was grounded during recording by contact with a sharp metallic clip. The image was developed by dipping the sheet into a pan of electrically charged liquid toner of the blue positive type. An example of this toner is described in U.S. Pat. No. 2,907,674. Sharply defined, densely colored traces appeared wherever the probe had been passed over the sheets. By comparison, similar sheets without suitable grounding or without pre-illumination, or lacking both, showed only faint or poorly defined traces or none at all.

EXAMPLE II

A series of experiments was performed to determine the time period after prior actinic illumination during which effective recording could be performed on zinc-oxide coated sheets. It was found that periods up to 30 seconds of time delay were permissible, depending on the actinic intensity of the light source, also depending on the light sensitivity of the layer, provided that the zinc-oxide layer retained a surface conductivity at the time of recording in excess of $10^{-8}$ mho-squares, preferably in excess of $10^{-7}$.

EXAMPLE III

The experiment of Example I was modified by substituting a totally insulating base consisting of a 7.5 mil thick "Mylar" polyester film. The sensitive coating was a somewhat different zinc-oxide suspension, consisting of 3.5 parts by weight of dye sensitized USP 12 zinc-oxide to 1 part of an epoxy ester. The ester was of a type sold under the tradename "Epidene E150", manufactured by the T. F. Washburn Co. of Chicago. The mixture was suspended in a toluene-xylene solvent and coated to a dry thickness of 0.6 mil. The photoconductive layer was overcoated with a 0.4 mil thick insulating film prepared from a resinous latex suspension so called "Xeroplex Resin," also sold by the Washburn Company. In other respects, the exposure, the grounding means and the development were the same as in Example I and similar results were obtained. Dense sharp traces were obtained with pre-illumination and grounding. If either of these was omitted, no image was formed.

EXAMPLE IV

A zinc oxide suspension identical with that used in Example III was coated as a 0.3 mil thick layer over a 1 mil thickness polyvinyl fluoride film marketed by E. I. DuPont de Nemours under the tradename "Tedlar". The zinc-oxide layer side of the film was laid for about 10 seconds over a light box covered by glass plate and containing a set of five 15 watt BLB fluorescent lamps located about 3 inches from the sheet itself. The pre-illuminated sheet was then darkened, clipped to a grounded wire, laid over an insulating base and brushed with a fine 1.0 kv probe as before. The image was developed as described above. A period of about 5 seconds elapsed between pre-illumination and recording. Fine dense images appeared in the pre-illuminated areas, but none in the dark areas. Similar results were obtained on a 2 mil "Mylar" polyester film base.

EXAMPLE V

A sheet of 2 mil "Mylar" polyester base, coated with a 0.4 mil thick layer of zinc oxide in an epoxy ester binder of the type described above in Example III, was partially overcoated with a 0.4 mil thick layer of the insulating latex described in Example III. The treated base was kept in the dark. Sample strips of overcoated and bare zinc-oxide layers were illuminated equally from the emulsion side by means of a pair of 15 watt BLB fluorescent lamps from a distance of 2 inches from the surface. Various periods of time were used for the illumination. The surface conductivity was measured on the bare zinc oxide coating by means of a pair of parallel knife blade electrodes 1 inch long and ½ inch apart pressed in surface contact with the bare zinc oxide coating. A potential of 9 volts was applied between the electrodes. At the same time, a −1.0 kv. corona discharge point was used to record an electrostatic pattern upon the emulsion covered portions of the sample.

During recording the sheet, treated as above, was grounded by contact of the edge of the illuminated zinc oxide layer to a conductive base plate. Measurements of conductivity were performed by means of a General Radio type 130A electrometer. The results obtained are tabulated in Table II. Variable exposure times were employed to vary the surface conductivity.

TABLE II

| Surface Conductivity of Zinc Oxide Coating | Appearance of Developed Trace |
|---|---|
| $0.5 \times 10^{-9}$ (ohms/square)$^{-1}$ (dark conductivity) | Faint series of poorly resolved pots (e.g., 1 mm. diam., 1 mm. apart) |
| $1.5 \times 10^{-9}$ | Slightly improved density, spotty |
| $0.5 \times 10^{-8}$ | Improved density, less prominent spots |
| $1.5 \times 10^{-8}$ | Dense, continuous trace |
| $5.0 \times 10^{-8}$ | Dense, continuous trace |
| $1.5 \times 10^{-7}$ | Dense, continuous trace |

EXAMPLE VI

A sheet of 2.0 mil "Mylar" was coated with a 0.3 mil layer of poly(N-vinyl carbazole). Three parts of the polymer by weight and one part of "Fluorol" dye (GAF Corp.) were dissolved in methylene chloride. The photoconductive layer was then overcoated with a 0.3 mil layer of the "Xeroplex" resin previously mentioned. One-half of a sample of this coating was illuminated as in Example V. At the same time a −1 Kv needle point was placed on the electrostatic charge pattern on both the dark and the illuminated portions of the sample. Weak, spotty traces were observed on both parts of the sample. Another sample, without the "Xeroplex" layer, was illuminated in the same manner and its resistivity measured as in Example V. Conductivities were: Dark $1.6 \times 10^{-11}$, light $6 \times 10^{-10}$ mho-squares. Identical experiments were performed and similar results obtained with poly(N-vinyl carbazole), "Fluorol OB" (3:1), poly(N-vinyl carbazole), and acenaphthylene picrate (3:1).

EXAMPLE VII

A poorly conductive bond paper was coated with a photoconductive precoat consisting of a slurry of 3.5 parts of zinc oxide sensitized with a trace of bromphenol blue, to one part of a highly insulating latex emulsion containing Washburn's "Xeroplex". A dry coating thickness of 0.6 thousandths of an inch was prepared. After drying, this precoated sheet was overcoated with 0.3 mil layer of highly insulating unpigmented resin emulsion. The sheet was illuminated from its coated or front side by means of a pair of 15 watt BLB fluorescent lamps at a distance of 4 inches. The technique of recording, grounding and developing was substantially identical with that of Example I. Dense blue traces were obtained in illuminated areas but not in the dark areas.

EXAMPLE VIII

The experiment of Example VII was repeated with similar results. The following overcoating resins were employed, the paper base and zinc oxide layers being identical in all cases:

a. A water-soluble insulating copolymer of vinyl acetate and crotonic acid with a dry film thickness of 0.2 mil.
b. An acrylonitrile-styrene copolymer latex dry film, thickness 0.4 mil.
c. A styrene-butadiene polymer latex dry film, thickness 0.6 mil.

It appears that any adequately resistive dielectric coating may be used. Although the examples describe only experiments with unpigmented dielectric resins, one may mix convenient insulating pigment filters such as titania, quartz powder, mica, and the like and it is even possible to add surprisingly large percentages of photoconductive pigments, such as zinc oxide. However, the weight ratio of pigment to binder should always be below 2:1 and preferably below 1:1 to minimize the direct electrical contact between adjacent particles.

It will be apparent that various modifications may be made in the process described so far and it is intended that obvious variants to those skilled in the art be covered in the claims as far as the prior art permits.

What is claimed is:

1. An electrostatic recording element suitable for use as a receiving sheet in an electrostatic transfer process, consisting essentially of a translucent, non-conductive base selected from the group consisting of paper, a polyester film, and a polyvinyl fluoride film; a photoconductive layer on the surface of said base comprising a photoconductive zinc oxide and a dye sensitizer suspended in an insulating resin binder selected from the group consisting of a vinyl acetate-crotonic acid copolymer and epoxy esters; and a dielectric polymer resin film overlying said photoconductive layer selected from the group consisting of polyvinyl acetate, vinyl acetate-crotonic acid copolymer, and acrylonitrilestyrene copolymer.

* * * * *